US008307597B2

(12) United States Patent
Tucker, Jr.

(10) Patent No.: US 8,307,597 B2
(45) Date of Patent: Nov. 13, 2012

(54) MODULAR FLOOR SYSTEM

(76) Inventor: Donald E. Tucker, Jr., Liberty Lake, WA (US)

( * ) Notice: Subject to any disclaimer, the term of this patent is extended or adjusted under 35 U.S.C. 154(b) by 120 days.

(21) Appl. No.: 12/717,903

(22) Filed: Mar. 4, 2010

(65) Prior Publication Data

US 2011/0214377 A1 Sep. 8, 2011

(51) Int. Cl.
*E04F 15/22* (2006.01)

(52) U.S. Cl. ..... 52/480; 52/403.1; 52/582.1

(58) Field of Classification Search ..... 52/403.1, 52/581, 592.1, 591.1, 480, 588.1, 582.1, 52/311.2, 313, 390; 404/35, 40, 41, 46; 108/53.1; 472/92; 428/50
See application file for complete search history.

(56) References Cited

U.S. PATENT DOCUMENTS

| | | | | | |
|---|---|---|---|---|---|
| 1,045,219 | A | | 11/1912 | Tramill et al. | |
| 1,407,679 | A | * | 2/1922 | Ruthrauff | 52/480 |
| 1,660,480 | A | * | 2/1928 | Daniels | 52/390 |
| 1,778,352 | A | | 10/1930 | Bruce | |
| 1,925,070 | A | | 8/1933 | Livezey | |
| 2,027,292 | A | * | 1/1936 | Rockwell | 52/396.1 |
| 2,652,753 | A | * | 9/1953 | Smith | 404/41 |
| 2,819,026 | A | * | 1/1958 | Leyendecker | 238/10 R |
| 3,387,422 | A | * | 6/1968 | Wanzer | 52/387 |
| 3,515,620 | A | * | 6/1970 | McPherson | 428/50 |
| 4,289,420 | A | | 9/1981 | Davis et al. | |
| 4,443,989 | A | * | 4/1984 | Silvey et al. | 52/402 |
| 4,462,712 | A | * | 7/1984 | Penland, Sr. | 404/36 |
| 4,538,392 | A | | 9/1985 | Hamar et al. | |
| 4,600,336 | A | | 7/1986 | Waller, Jr. | |
| 4,759,164 | A | * | 7/1988 | Abendroth et al. | 52/403.1 |
| 4,860,516 | A | * | 8/1989 | Koller et al. | 52/480 |
| 4,930,280 | A | * | 6/1990 | Abendroth | 52/403.1 |
| 5,020,286 | A | | 6/1991 | Hamar et al. | |
| 5,313,756 | A | * | 5/1994 | Ways et al. | 52/263 |
| 5,497,590 | A | * | 3/1996 | Counihan | 52/385 |
| 5,647,183 | A | * | 7/1997 | Counihan | 52/403.1 |
| 5,755,068 | A | * | 5/1998 | Ormiston | 52/314 |
| 5,822,944 | A | | 10/1998 | Penland, Sr. | |
| 5,987,839 | A | * | 11/1999 | Hamar et al. | 52/582.1 |
| 6,055,785 | A | * | 5/2000 | Counihan | 52/403.1 |
| 6,115,981 | A | * | 9/2000 | Counihan | 52/403.1 |
| 6,367,217 | B1 | * | 4/2002 | Niese et al. | 52/480 |
| 6,474,905 | B1 | | 11/2002 | Smith, Jr. et al. | |
| 6,557,314 | B2 | | 5/2003 | Shelton | |
| 7,886,497 | B2 | | 2/2011 | Pervan | |
| 2002/0178675 | A1 | * | 12/2002 | Valentine | 52/403.1 |

(Continued)

FOREIGN PATENT DOCUMENTS

EP 455616 A1 * 11/1991

OTHER PUBLICATIONS

"Action Hardwood Floors Inc.", retrieved on Mar. 3, 2010 at <<http://actionhardwoodflooring.com/>>, 2 pages.

(Continued)

*Primary Examiner* — Brian Glessner
*Assistant Examiner* — Babajide Demuren
(74) *Attorney, Agent, or Firm* — Lee & Hayes, PLLC

(57) ABSTRACT

A modular floor system comprises modular floor panels and zippers that are fabricated in a manufacturing facility and subsequently installed in a facility. By virtue of being fabricated in the manufacturing facility the modular floor is subsequently installed in the sports facility with minimal labor and cost, while providing superior performance.

4 Claims, 11 Drawing Sheets

U.S. PATENT DOCUMENTS

| | | | | |
|---|---|---|---|---|
| 2003/0172608 | A1* | 9/2003 | Chambers | 52/480 |
| 2003/0200713 | A1* | 10/2003 | McStay | 52/311.2 |
| 2008/0295433 | A1 | 12/2008 | Eyal et al. | |
| 2009/0193747 | A1 | 8/2009 | Chorney et al. | |

OTHER PUBLICATIONS

Connor Alliance, Section 09642—Wood Gymnasium Flooring, Nov. 26, 2007, Alliance 005, Master Rev D, pp. 1-4.

"Connor Sports Flooring—A complete line of maple hardood courts and synthetic athleti . . . ". retrieved on Mar. 3, 2010, at <<http://www.connorfloor.com/>>, 1 page.

Connor Sports Flooring, Alliance Fixed Resilient, retrieved on Mar. 11, 2010 at <<http://www.connorfloor.com/downloads/connor/sales_sheets/alliance.pdf>>, 1 page.

Horner Balanced Performance (BPS) System, Section 096466—Wood Gymnasium Flooring, Nov. 1, 2009, 5 pages.

"Horner Sports Flooring—the Leader in Sports Flooring, since 1891", retrieved on Mar. 3, 2010, at <<httpL//www.hornerflooring.com/>>, 1 page.

Horner, Balanced Performance System—BPS—retrieved on Mar. 10, 2010 at <<http://www.hornerflooring.com/pdfs_brochures/bro_bps.pdf>>, 2 pages.

Robbins Floor: Mach 1#top, retrieved on Mar. 10, 2010 from <<http://www.robbinsfloor.com/mach1.html#top, 4 pages.

Robbins Floor: Sportplay, retrieved on Mar. 8, 2010 at <<http://www.robbinsfloor.com/sportplay.html>>, 3 pages.

"Robbins Sports Surfaces", retrieved on Mar. 3, 2010 at <<http://www.robbinsfloor.com/homepage.html>>, 1 page.

W-D Flooring Athletic Systems, Anchored Elite System, retrieved on Mar. 11, 2010 at <<http://www.wdflooring.com/athletic/extraImages/WD_SpecElite.pdf>>, 2 pages.

"WD Flooring", retrieved on Mar. 3, 2010, at <<http://wdflooring.com/>>, 1 page.

WD Flooring Anchored Elite System, retrieved on Mar. 10, 2010 at <<http://www.wdflooring.com/athletic/sys1elite.htm>>, 1 page.

"Welcome to Champion Hardwood Floors ~ A Leading California Flooring Contractor off . . . ", retrieved on Mar. 3, 2010, at <<http://championhardwoodfloors.net/>>, 3 pages.

PCT Search Report mailed Nov. 23, 2011 for PCT application No. PCT/US11/27008, 9 pages.

* cited by examiner

MODULAR FLOOR SYSTEM

BACKGROUND

Traditional hardwood sport floors are labor intensive permanent installations, which are fixtures of the facilities the hardwood floors are installed in. The on-site installation of the traditional hardwood sport floors involves multiple personnel utilizing field equipment in adverse conditions. Typically, traditional hardwood floors require personnel to install a subfloor, some where the subfloor may be made of pre-engineered units, such as PowerPlay® pre-engineered units, made by Aacer Flooring® of Peshtigo, Wis. Subsequent to installing the subfloor, personnel would then install hardwood flooring. The hardwood flooring is subsequently installed by nailing or stapling individual tongue and groove boards to the previously installed subfloor. After which, personnel finish the installed floor by sanding the floor, sealing the floor (for a first time), buffing the floor, sealing the floor (for a second time), striping the floor (e.g., applying game lines, letters, borders, logos to the floor), and finally, applying two consecutive coats of finish to the floor.

Sanding of the traditional hardwood floors requires personnel to walk behind or drive sanding equipment repeatedly about the installed floor, until the appropriate smoothness is achieved. In some instances, personnel may be sanding in less than adequate conditions, such as poor lighting, poor ventilation, extreme temperatures, and/or extreme humidity, just to name a few. Additionally, the very nature of sanding an installed traditional hardwood floor produces "chatter marks," which is a result of sanding a floor with a standard split drum sander and the shock absorption design characteristics of the subfloor (i.e., a floor installed on pre-engineered subfloor panels with resilient pads). If an installed hardwood floor has excessive "chatter marks," then personnel would need to further sand the hardwood surface in an attempt to remove the "chatter marks." Personnel would be required to minimize the "chatter marks" before applying a sealer to the floor installed hardwood floor. However, once created "chatter marks" are difficult remove. "Chatter marks" are but one of the many challenges associated with installing a traditional hardwood floor. For example, after sanding the traditional hardwood floor, personnel would then attempt to seal the floor for the first time. To do so, personnel would thoroughly clean the sanding debris from the floor to subsequently apply the sealer to the hardwood floor (i.e., repeatedly sweeping and vacuuming the floor). Here, the sealer to be applied may require proper ventilation of the facility in which the traditional hardwood floor is being installed. In some instances, a proper dust free, with minimal air movement, and proper ventilation of the facility is difficult to achieve, which adds to the labor required to complete the traditional hardwood floor installation, as well as adds a significant health hazard. Furthermore, once the traditional floor is installed it becomes a fixture of the building and cannot practically be removed.

Some venues use portable floors, which can be assembled and removed as needed. For example, an arena that hosts both hockey and basketball teams might use a portable floor that can be assembled on top of an ice skating surface. Installation of existing portable floors may not be as labor intensive as the on-site installation of the traditional hardwood floors. However, existing portable floors present other problems, such as poor performance and visible interconnecting seams. Because existing portable floors are designed to be easily installed in a facility, the portable floor panels have regular surfaces or edges. As a result, after the portable floor has been installed the regular surfaces or edges are noticeably visible and not aesthetically appealing. Also, existing portable floors are designed to have fewer interconnections to reduce the labor and associated equipment required to complete the portable floor installation. As a result of designing simple interconnecting portable floor panels to be installed with minimal labor and equipment, the installed traditional portable floor is not as robust as an on-site installation of a traditional hardwood floor and therefore yields a poorly performing floor.

Thus, traditional hardwood floors are labor intensive, and require extensive time and equipment to install on-site. On the other hand, portable floors may be less labor intensive, but are more expensive, perform poorly compared to a traditional floor, and are not as aesthetically pleasing as a traditional floor.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1A:
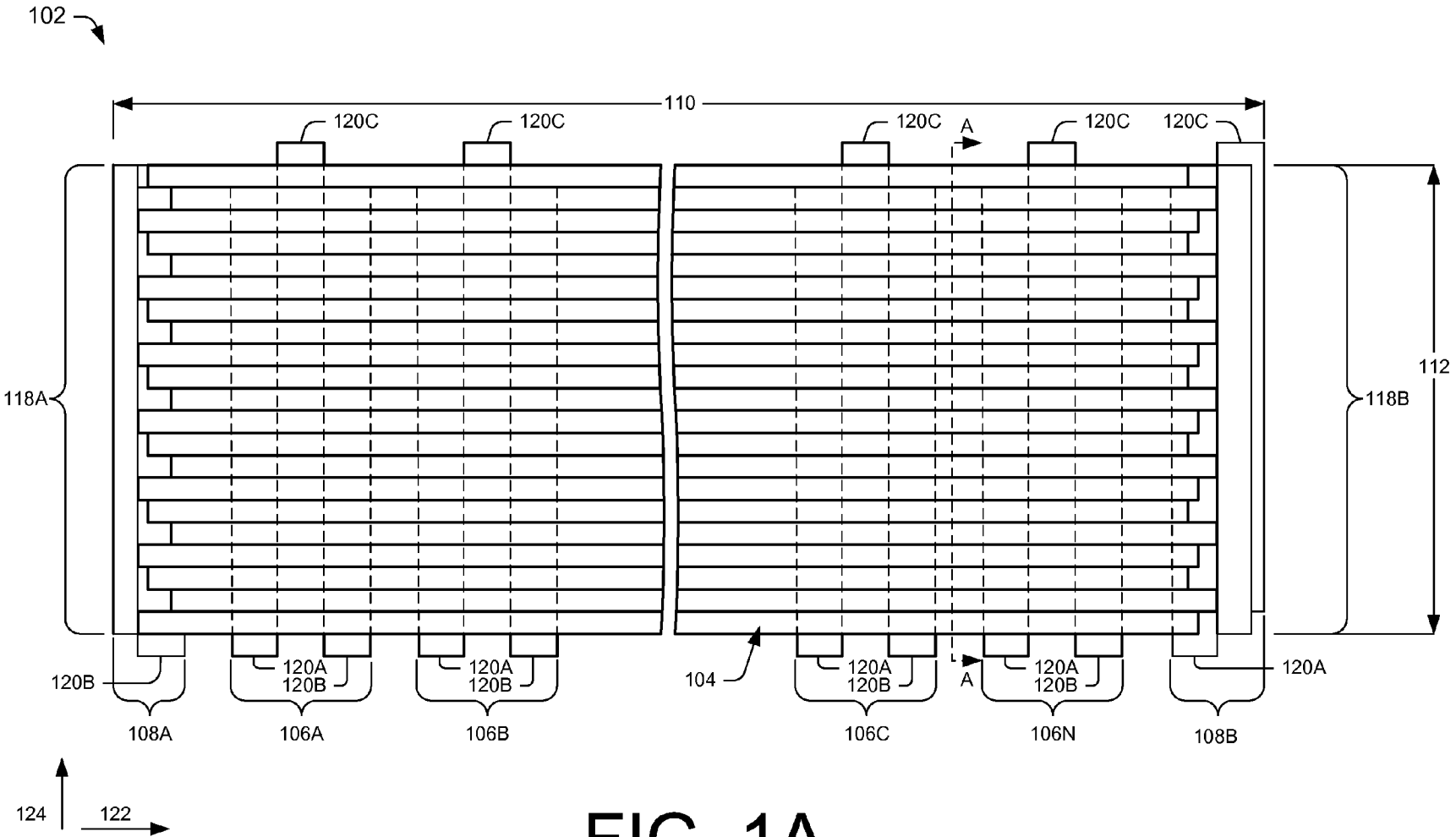
FIG. 1A and FIG. 1B depict an illustrative modular floor panel in a top view and a side view, respectively.

This application describes modular floor systems that comprise multiple modular floor panels that are pre-fabricated, easily installed and not permanent. The modular floor is assembled to provide a substantially planar playing floor surface, which comprises multiple modular floor panels arranged adjacent to one another in a longitudinal dimension and a latitudinal dimension. As used herein the term "longitudinal" is used to refer to a direction parallel with a longest dimension of the modular floor panels and the term "latitudinal" is used to refer to a direction perpendicular to the longitudinal direction. Each of the modular floor panels has a substantially planar floor surface, that when installed proximate to each other provide the playing floor surface.

In some embodiments, a "zipper" may be used to integrate modular panels together to provide the playing floor surface, while in other embodiments, the zipper may be omitted. In the embodiments described herein, a zipper is used between two longitudinally adjacent modular floor panels to span a gap between fingers of the longitudinally adjacent floor panels, while the modular floor panels are installed immediately adjacent to each other (i.e., without a zipper) in the latitudinal direction. The zipper provides a smooth, stable transition from one modular floor panel to another in the longitudinal direction, which is not readily perceptible and is, therefore, aesthetically pleasing.

In some embodiments, the multiple modular floor panels may be coupled to each other via footings, which are coupled to and below the substantially planar floor surface. More specifically, to be coupled "to and below" the substantially planar floor surface is to be coupled to a member that defines the surface, but need not actually be coupled to the surface itself. For example, the substantially planar floor surface comprises a top surface and a bottom surface planar to the top surface, and the footings are coupled to the bottom surface, which is below the top surface. Further, each of the multiple footings has a tongue extending distally from the footing in the latitudinal direction for interconnecting with the immediately adjacent modular floor panel in the latitudinal direction. The substantially planar floor surface of the multiple modular floor panels are separated by gaps in the longitudinal direction, which are subsequently filled and integrated with zippers.

The modular floor panels may be pre-fabricated in a manufacturing facility and delivered to a site ready to be installed with minimal labor and field equipment. The zippers may be either a pre-fabricated kit or a pre-assembled "drop-in" unit. In either configuration (i.e., as a kit, or as a drop-in unit), the zippers are configured for quickly and easily integrating the modular floor panels installed in the longitudinal direction without producing readily apparent seams.

The substantially planar floor surface of the modular floor panels may be made of a variety of materials. In the embodiments described herein, the substantially planar floor surface is made of tongue and groove maple boards about 25/32 inches thick, and 2 and ½ inches wide, which may be random-length strips or finger-joint strip.

Random-length strip comprise individual pieces of flooring, typically 1 and ½ inch, 2 and ¼ inch, 2 and ½ inch, or 3 and ¼ inch widths, in lengths between 9 inches and 8 feet are available. The most common thickness specified is 25/32 inch, but other thicknesses are also available, such as 33/32 inch and ½ inch. This surface material is installed like a horizontal brick wall, with each piece being overlapped with adjacent pieces and fastened into the subfloor with cleats, staples or steel clips, depending on the subfloor chosen for the project. The Maple Flooring Manufactures Association, Inc. (MFMA) subfloor configurations are compatible with MFMA random-length strip flooring.

Finger-jointed strip comprise a number of random-length strip segments joined together at the manufacturing plant to form a consistent length board, typically 2 and ¼ inches wide. The most common thickness specified is 25/32 of an inch, but other thicknesses are also available, such as 33/32 inches and ½ inch thick finger-jointed strip flooring is also available. This finger-jointed material is also installed like a horizontal brick wall, with each consistent-length board being overlapped with adjacent boards and fastened into the subfloor with cleats, staples or steel clips, depending on the subfloor chosen for the project. Most MFMA subfloor configurations are compatible with MFMA finger-jointed strip flooring.

The modular floor panel length is approximately twenty feet long. However, the tongue and groove boards may be any other desired dimensions. For example, in one embodiment, tongue and groove maple boards of about ¾ inch thick, 2 inches wide, and random lengths totaling twenty feet long may be used. Further, other types of woods may also be used, such as cherry, red oak, white oak hickory, beech, walnut, or any other wood suitable for use as a floor surface. Still further, other materials may also be used to make the substantially planar floor surface. For example, engineered wood, such as, products available from Huber Engineered Woods™ of Charlotte, N.C., plastic, ceramic, rock, metal, fiberglass, laminates, composites, plywood, oriented strand board, dimensional lumber, recycled composites combinations of the forgoing, or the like may be used to make the substantially planar floor surface. In one specific alternative embodiment, the modular floor panels may be made of engineered woods, as discussed above, with a laminate disposed on the substantially planar floor surface that is aesthetically pleasing (e.g., a wood veneer).

The modular floor as described herein, provides for a modular floor that is readily installed with less labor and less cost, while maintaining superior performance and being aesthetically pleasing. Further, as a product of the modular floor's modularity, the modular floors may be considered a furnishing, rather than a fixture of facilities the modular floors are installed in. Thus, the modular floor may be removed from one facility and reinstalled in another facility. Further, the modular floor is sustainable, as it is reusable instead of being torn out and disposed of. Moreover, because the modular floor may be considered a furnishing rather than a fixture, it need not be included within the original building permit for a structure, further reducing the cost of installing the modular floor. Additionally, as a furnishing, the modular floor may be depreciated over a much shorter time than if it were a fixture.

Illustrative Modular Floor Panel

Figure 1B:
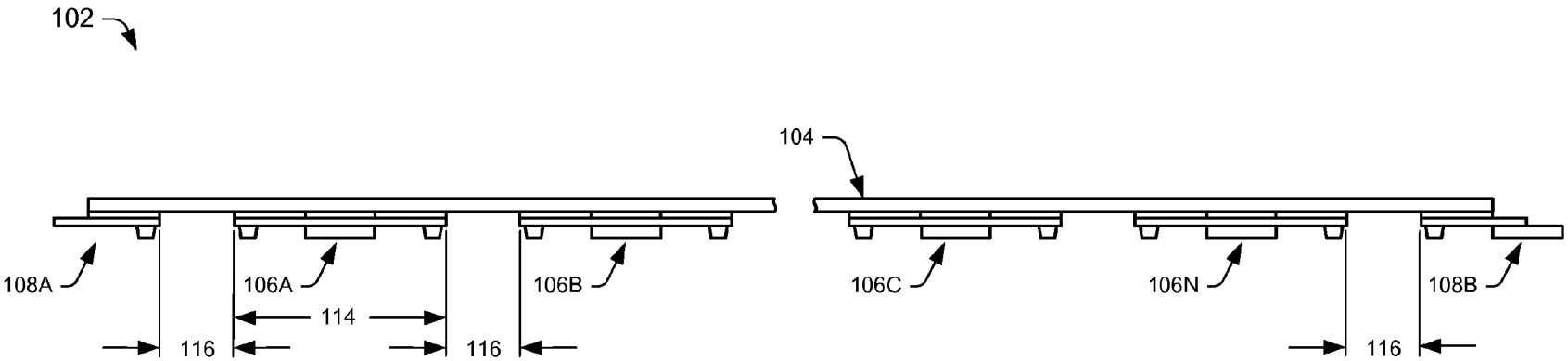

FIG. 1A depicts an illustrative modular floor panel 102 in a top view and FIG. 1B depicts the illustrative modular floor panel 102 in a side view. The modular floor panel 102 includes a rugged and hard substantially planar floor surface 104, with multiple footings 106A-106N, and two half-footings 108A and 108B, all of which are coupled to and below the substantially planar floor surface 104. In the illustrated embodiment, each modular floor panel 102 is about twenty feet in length 110 and about four feet in width 112. However, in other embodiments, the modular floor panels may have different dimensions. Further, while modular floor panel 102 is illustrated as a modular panel about twenty feet in length, modular panel 102 may be shortened, if required, by simply cutting or trimming the unnecessary length. The trimmed portion may subsequently be used to assemble additional modular flooring. For example, if a modular wood floor has a length of ninety feet then five modular floor panels 102 would be required, where one of the twenty modular floor panels would be trimmed by ten feet. In that case, the trimmed ten foot portion of a modular floor panel 102 would be used to start another row of modular floor panels 102.

In FIG. 1B, each footing 106A-106N is illustrated to be about two feet in length 114, and in FIG. 1A, each footing 106A-106N is illustrated to be about the same width 112 as the modular floor panel 102 (i.e., four feet in width). Each footing 106A-106N has its two foot length 114 orientated parallel with the twenty foot length 110 of the modular floor panel 102 and an 7 inch gap 116 is illustrated in FIG. 1B between each footing 106A-106N, and between half-footing 108A and footing 106A and half-footing 108B and footing 106N.

FIG. 1A illustrates a set of planar fingers 118A extending distally from the substantially planar floor surface 104 and another set of planar fingers 118B also extending distally from the substantially planar floor surface 104 in the opposite direction to the set of planar fingers 118A. Planar fingers 118A and 118B are made of the same rugged and hard material as the substantially planar floor surface 104. Both sets of planar fingers 118A and 118B are illustrated in FIG. 1A as having similar staggered patterns for integrating with another modular floor panel 102 so that the seams of integrated modular floor panels 102 in the longitudinal direction 122 are not readily apparent. Further, illustrated in FIG. 1A, is a set of tongues 120A-120C extending perpendicular to the set of planar fingers 118A and 118B and distally from each of the footings 106A-106N. Half-footing 108A is illustrated in FIG. 1A as comprising only tongue 120B, while half-footing 108B is illustrated as comprising both tongues 120A and 120C. As described below in more detail with respect to FIG. 3, tongues 120A-120C are for integrating modular floor panels in the latitudinal direction 124.

Figure 2:
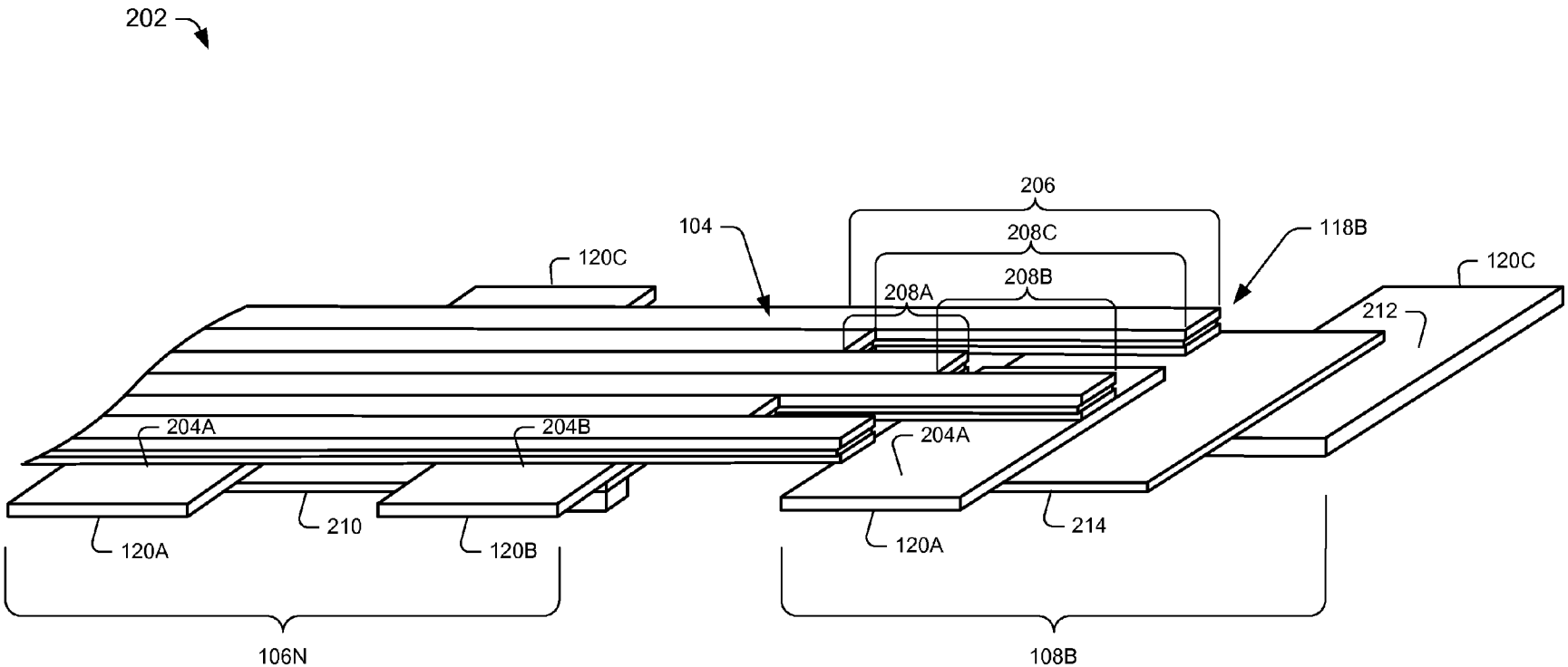
FIG. 2 is an illustrative isometric view showing additional details of a portion of the modular floor panel of FIG. 1 including planar fingers extending in a longitudinal direction of the modular floor panel.

FIG. 2 is an illustrative isometric view showing additional details of a portion of the modular floor panel of FIG. 1A and FIG. 1B. As discussed above, and illustrated in FIG. 2, substantially planar floor surface 104 is coupled to footing 106N and half-footing 108B. The boards comprising the substantially planar floor surface 104 are enlarged for clarity in this figure and, therefore, each modular floor panel 102 in this figure includes fewer boards than in FIGS. 1A and 1B. Further, and as discussed above, planar fingers 118B extend distally from substantially planar floor surface 104. Specifically, as illustrated in FIG. 2, substantially planar floor surface 104 and planar fingers 118B are formed of individual tongue and groove boards coupled to supports 204A and 204B, such that the planar fingers 118B extend distally from the substantially planar floor surface 104 in a staggered pattern 206. As FIG. 2 illustrates, planar fingers 118B are staggered distally from the substantially planar floor surface 104 in about six inch increments 208A-208C. While FIG. 2 illustrates a staggered pattern 206 with about six inch increments 208A-208C, other increment lengths are contemplated. For example, four inch increments, eight inch increments, ten inch increments or combination of the foregoing.

FIG. 2 further illustrates, supports 204A and 204B being coupled to a deck 210, and an anchor 212 is coupled below the deck 210. Here, deck 210, supports 204A and 204B, and anchor 212 are each illustrated as being made of plywood. Tongues 120A-120C are illustrated in FIG. 2 to be extending distally from footing 106N. Half-footing 108B is illustrated in FIG. 2 as comprising tongue 120A, support 204A, half-deck 214 and anchor 212.

Illustrative Footing

Figure 3:
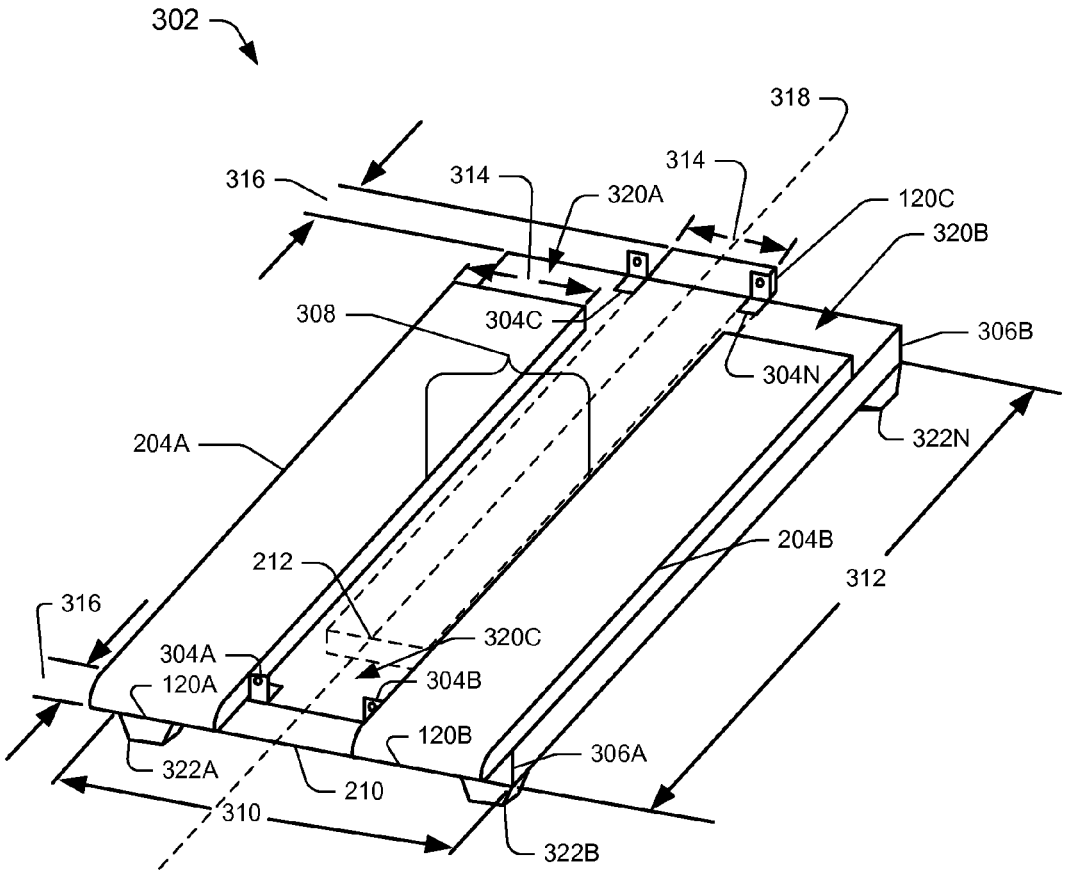
FIG. 3 illustrates a footing of the modular floor panel of FIG. 1 in more detail, with the substantially planar floor surface and planar fingers not shown.

FIG. 3 illustrates a footing (e.g., 106A-106N) of FIG. 1 in more detail, with the substantially planar floor surface 104 and planar fingers 118A and 1188 omitted for clarity. FIG. 3 illustrates footing 302 having multiple fasteners 304A-304N coupled to deck 210. Specifically, FIG. 3 illustrates multiple fasteners 304A-304N disposed along opposite edges 306A and 306B of deck 210. Fasteners 304A-304N are disposed in an aperture 308 defined between the substantially planar floor surface 104 and deck 210. While bracket type fasteners 304A-304N are illustrated in FIG. 3, multiple different types of fasteners 304A-304N are contemplated. For example, snap type fasteners, threaded fasteners, bayonet type fasteners, knock down type fasteners, Minifix™ type fasteners (available from ROCKLER® Woodworking and Hardware of Medina, Minn.), magnetic type fasteners, or any other type of fastener suitable for mating modular floor panels 102 together. Alternatively, modular floor panels 102 maybe mated together using a tension type fastener (e.g., by tightening a wire or cable using a turnbuckle).

Deck 210 is illustrated in FIG. 3, as one unit of material about forty-eight inches in length 310 and about twenty-four inches in width 312. FIG. 3 further illustrates tongues 120A and 120B each as one unit, made of the same material as supports 204A and 204B. Tongue 120C is also illustrated in FIG. 3 as one unit, and made of the same material as anchor 212. In some embodiments, the tongues 120A, 120B, and 120C may be beveled or rounded on one or both edges, as shown in FIG. 3, to facilitate insertion into the corresponding nooks in adjacent footings. However, in other embodiments the tongues 120A, 120B, and 120C may have sharp corners as shown in the other figures.

Further, FIG. 3 illustrates supports 204A and 204B being coupled linearly along width 312 and separated from each other by aperture 308. As discussed above, aperture 308 is defined between the substantially planar floor surface 104 and deck 210, on the top and bottom, and between the supports 204A and 204B on the sides. Aperture 308 is about eight inches wide between supports 204A and 204B. FIG. 3 illustrates supports 204A and 204B, and likewise, tongues 118A and 118B, as being about eight inches in width 314, with tongues 118A and 118B extend distally from footing 302 about a distance 316 of three inches. Similarly, FIG. 3 illustrates anchor 212 being about three and a half inches in width 314, with tongue 118C extend distally from footing 302 about a distance 316 of one inch. FIG. 3 further illustrates anchor 212 coupled to the bottom along the middle longitudinal axis 318 of deck 210. The supports 204A and 204B being each one unit are offset relative to the deck 210 so as to create the tongues 118A and 118B overhanging the deck on one side and nooks 320A and 320B on the side opposite to the tongues 118A and 118B. The anchor 210 being one unit is offset relative to the deck 210 in a direction opposite that of the supports 204A and 204B, so as to define the tongue 118C overhanging the deck on one side and a nook 320C as an indentation on the side opposite to the tongue 118C. Furthermore, and as illustrated in FIG. 3, with this configuration (i.e., nooks 320A, 320B, and 320C and tongues 118A, 118B, and 118C), each footing 106A-106N is configured to mate with complimentary features of adjacent footings, thereby coupling adjacent modular floor panels.

Damping mechanisms 322A-322N are illustrated in FIG. 3 as being coupled to and below the deck 210 and proximate to the perimeter of the deck 210. While FIG. 3 illustrates damping mechanisms 322A-322N being an off-the-shelf damper, such as, Aacer Flooring® Bi-Power® pad, other damping mechanisms are contemplated. For example, damping mechanisms 322A-322N may be a metal spring, plastic spring, multilayered rubber pads, air bladders, or any other material suitable for damping shock and/or vibration exhibited from the modular floor panel 102. Further, while FIG. 3 illustrates damping mechanisms 322A-322N coupled to and below the deck 210 and proximate to the perimeter of the deck 210, other locations and quantities are contemplated. For example, the damping mechanisms 322A-322N may be coupled to and below the deck 210 and be disposed proximate to the longitudinal axis 318 of the deck 210 and comprise one, or any quantity of damping mechanisms 322A-322N.

While footing 302 is illustrated in FIG. 3 as comprising multiple layers fastened together (i.e., deck 210, top supports 204A and 204B, and anchor 212), in other embodiments the footing 302 may be made integrally as one unitary member. In the case of multiple discreet layers, each layer may be made of the same material, or the layers may be made of different materials. In some cases, a single layer may be made of multiple materials (e.g., the bottom layer may include anchor 212 made of plywood and damping mechanisms 322A-322N made of rubber or other damping material). Further, it is contemplated that footing 302, and likewise footings 106A-106N, maybe of a single unit of material, where each footing 302 may be an integral unit. For example, footing 302 may be formed of a recycled and/or recyclable plastic or wood. Here, a footing 302 formed of a single unit of material (e.g., recyclable plastic) may be injection molded, extruded, or machined as a single unit.

Furthermore, while FIG. 3 illustrates tongues 118A-118C as being about eight inches in width 314 and extending distally from footing 302 about a distance 316 of one inch, other dimensions may be utilized. For example tongues 118A-118C may be about four inches in width 314 and extend distally from footing 302 about a distance 316 of one and half inches. Similarly, while deck 210 is illustrated in FIG. 3 as being about forty-eight inches in width 312 and about twenty-four inches in length 310, other dimensions may be utilized. For example, deck 210 may be about ninety-six inches in width, and/or about twenty-three inches in length. Likewise, footings 106A-106N may be similar in width and length as deck 210 (i.e., deck 210 width 312 and length 310 may be about the same as the dimensions of the footings).

Figure 4:
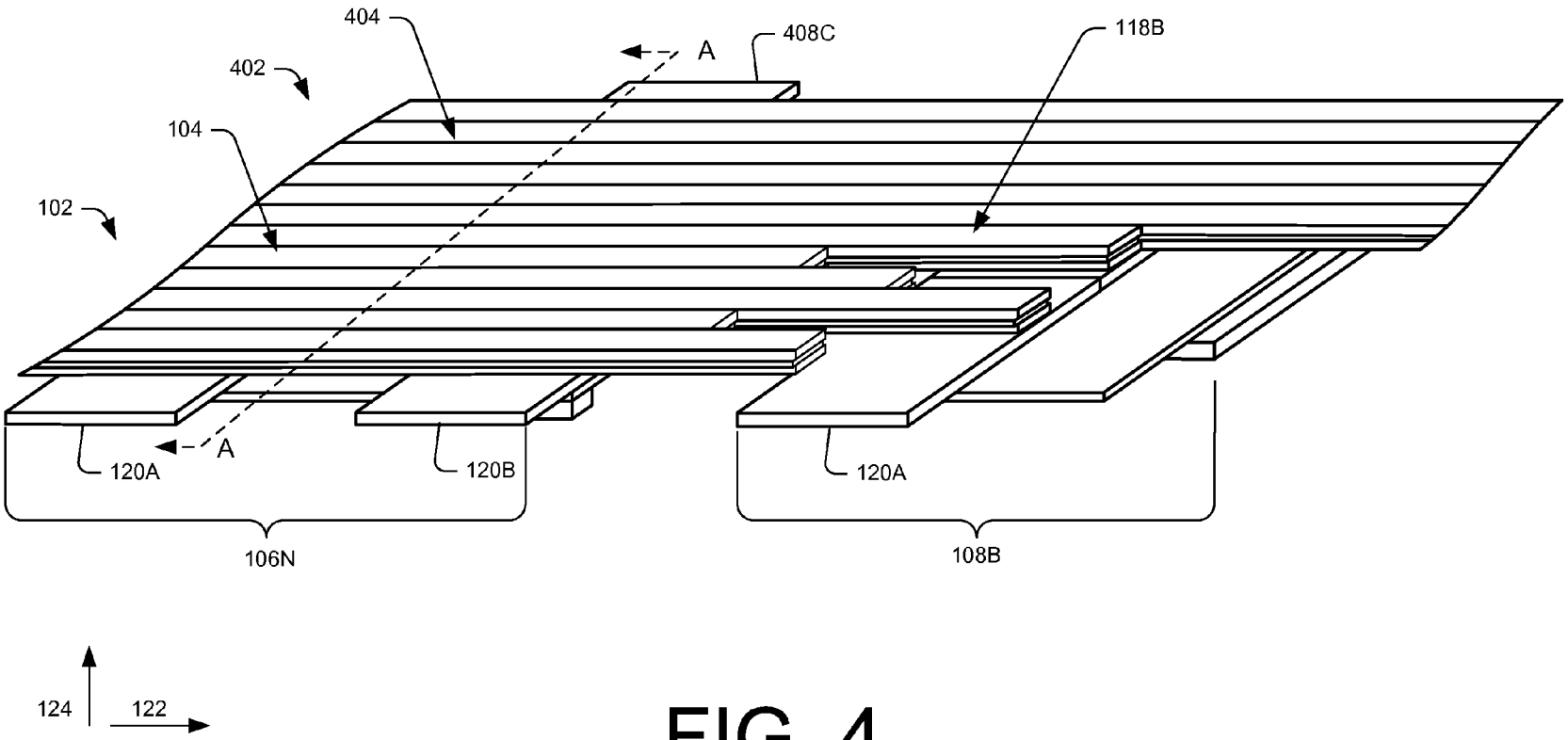
FIG. 4 depicts an illustrative isometric view showing two modular floor panels interconnected in a latitudinal dimension.

FIG. 4 depicts an illustrative isometric view showing two modular floor panels 102 and 402 interconnected along the twenty foot length 108. FIG. 4 illustrates substantially planar floor surface 104 of modular panel 102 disposed adjacent to substantially planar floor surface 404 of modular panel 402, and planar fingers 118B of modular panel 102 disposed adjacent to substantially planar floor surface 404 of modular panel 402. As illustrated in FIG. 4, substantially planar floor surface 404 of modular panel 402 extends past planar fingers 118B of modular panel 102 disposed adjacent to substantially planar floor surface 404. As in FIG. 2, the boards comprising the substantially planar floor surfaces 104 and 404 are enlarged for clarity in this figure and, therefore, each modular floor panel 102 and 402 in this figure includes fewer boards than in FIGS. 1A and 1B.

As discussed above, and as illustrated in FIG. 4, planar fingers 118B are staggered so as not to provide a discernable seam when the floor is assembled. Moreover, laterally adjacent modular floor panels 102 and 402 are also staggered relatively to one another so that the fingers 118B of one panel are spaced longitudinally from fingers of adjacent panels. This further minimizes visibility of seams between modular floor panels.

FIG. 4 further illustrates footing 106N and respective tongues 120A and 120B, as well as tongue 408C of modular floor panel 402. Half-footing 108B is also illustrated in FIG. 4 disposed directly adjacent to modular panel 402. As described above, FIG. 4 illustrates modular floor panel 102 mated to another modular floor panel 402, both of which are configured to mate with additional neighboring modular floor panels in both longitudinal direction 122 and latitudinal direction 124. Further, a section line A-A is illustrated in FIG. 4, where the section line A-A traverses both modular floor panels 102 and 402 in the latitudinal direction.

Figure 5:
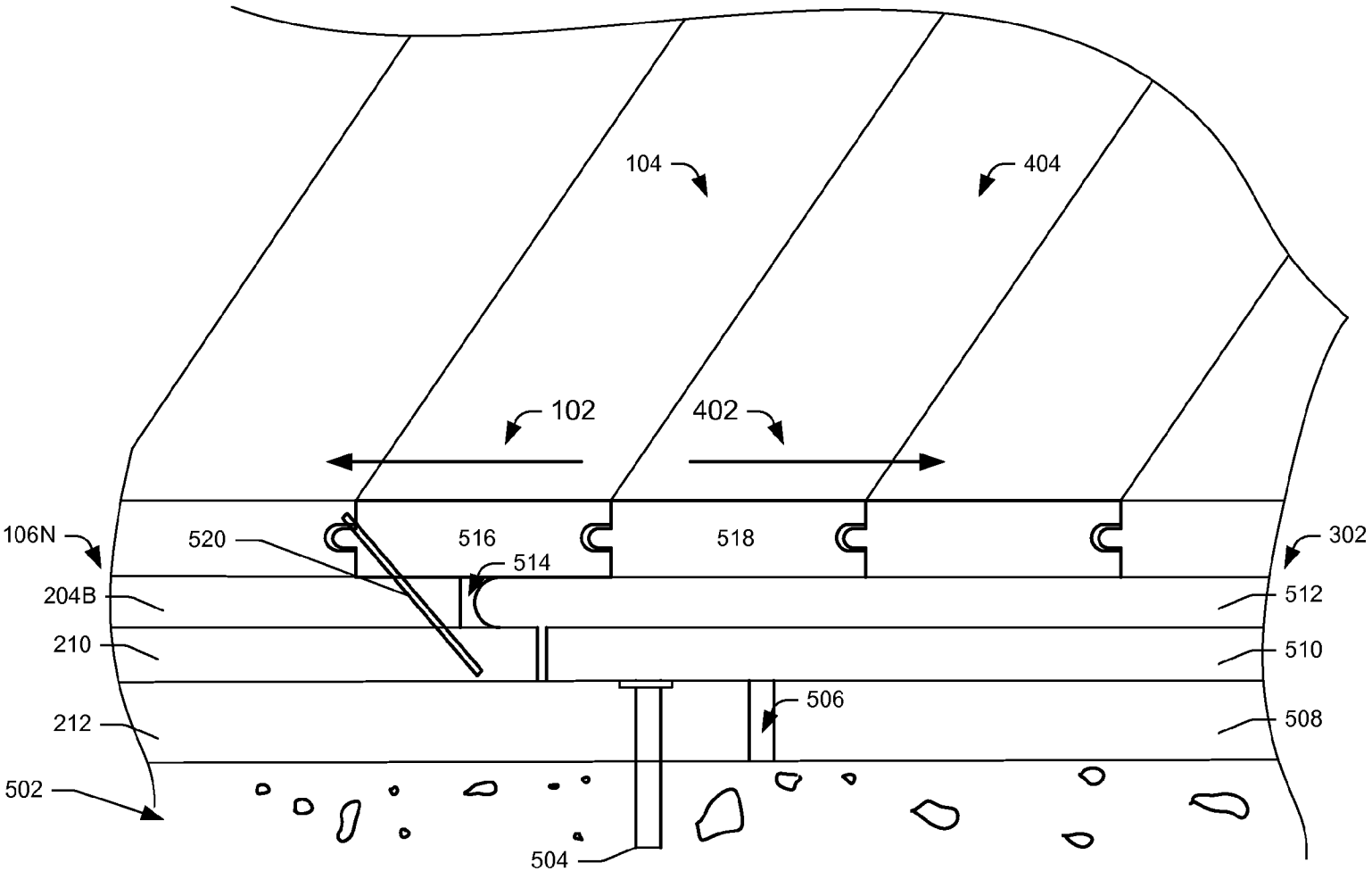
FIG. 5 depicts an illustrative section view taken along line A-A of the two interconnected modular floor panels of FIG. 4, and shown in perspective.

FIG. 5 depicts an illustrative section view taken along line A-A of two interconnected modular floor panels of FIG. 4. As described above, with respect to FIG. 4, modular floor panel 102 is mated longitudinally with modular floor panel 402 (i.e., modular floor panel 102 is disposed longitudinally adjacent to modular floor panel 402), and each of footings 106A-106N are interconnected with another footing (e.g., footing 302). As illustrated in the section view of FIG. 5, deck 210, top support 204B, and anchor 212 of footing 106N are each complimentary features of the other footing 302. Specifically, FIG. 5 illustrates anchor 212 of footing 106N anchored to a substrate 502, via a fastener 504, in a planar orientation. While footing 106N is illustrated in FIG. 5 as being fastened via fastener 504 to substrate 502, footing 106N may not be anchored via fastener 504 to substrate 502 and may instead "float" on top of the substrate. Additionally or alternatively, footing 106N may be fastened to another adjacent footing 302 (e.g., by fasteners 304), as described above with respect to FIG. 3, for holding a modular floor together. Anchor 212 is further illustrated in FIG. 5 to be received in nook 506 of footing 302. Adjacent to anchor 212 of footing 106N is anchor 508 of footing 302, which as illustrated in FIG. 5, is disposed on substrate 502 in a planar orientation. Next, FIG. 5 illustrates deck 510 of footing 302 coupled to anchor 508 of footing 302 and overlapping anchor 212 of footing 106N, and abutting (or nearly so) deck 210 of footing 106N. Next, FIG. 5 illustrates support 204B of footing 106N coupled to deck 210 of footing 106N abutting (or nearly so) support 512 of footing 302, which support 512 is illustrated received in nook 514 of footing 106N. Finally, substantially planar floor surface 104 of modular floor panel 102 is shown abutting substantially planar floor surface 404 of modular floor panel 402. Here, as illustrated in FIG. 5, the abutting substantially planar floor surface 104 comprises a tongue and groove board 516 mated linearly with a tongue and groove board 518 of substantially planar floor surface 404. The tongue and groove board 516 is shown held in place by fastener 520. The tongue and groove boards are held in place by other fasteners (not shown) spaced throughout the modular floor panels. Therefore, as illustrated in FIG. 5 each of footings 106A-106N are structurally integrated with another footing 302 and provide for modular floor panel 102 to mate with another adjacent modular floor panel 402.

Illustrative Zipper

Figure 6A:
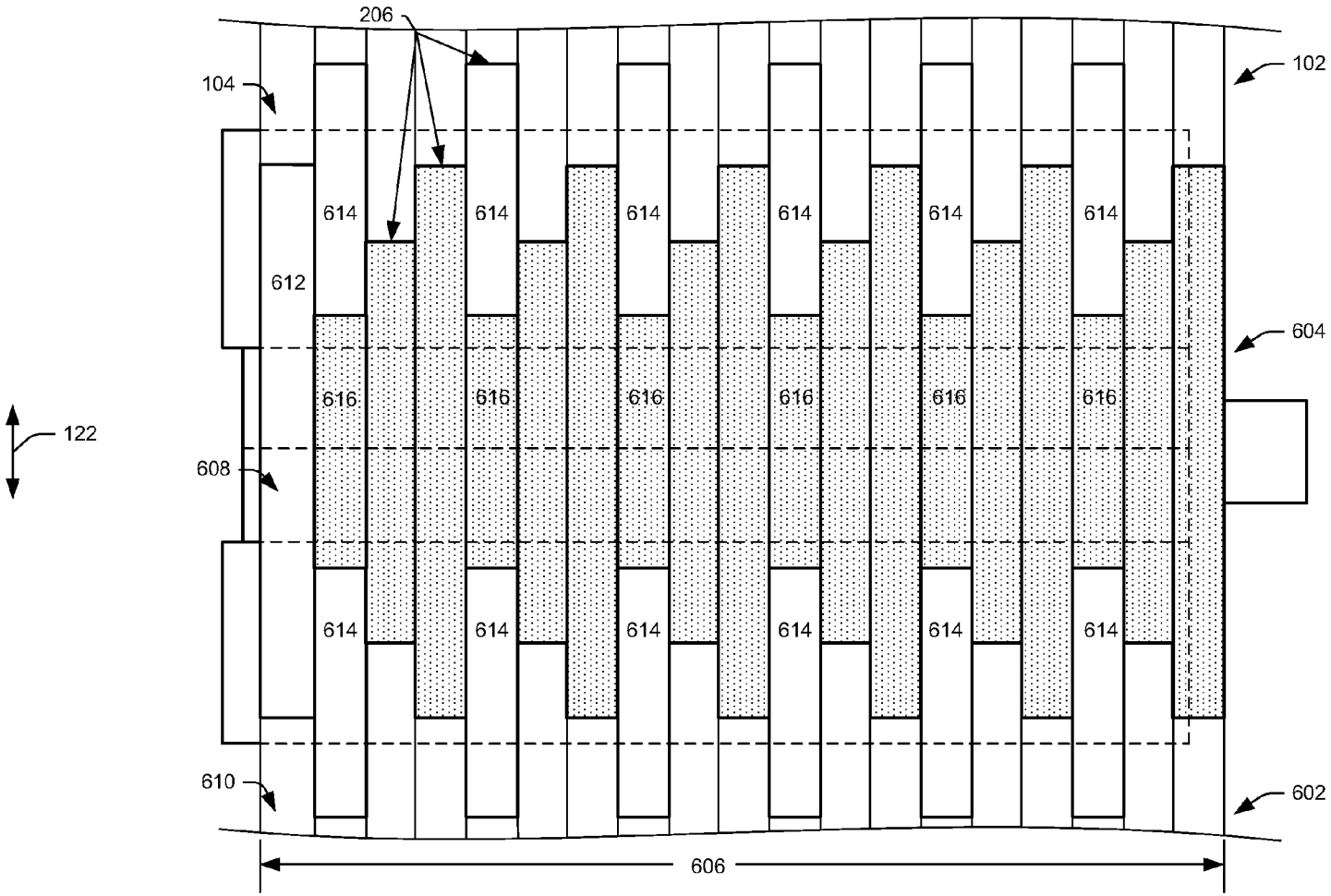
FIG. 6A and FIG. 6B depict an illustrative zipper kit used to integrate modular floor panels in a top view and an enlarged side view, respectively.
Figure 6B:
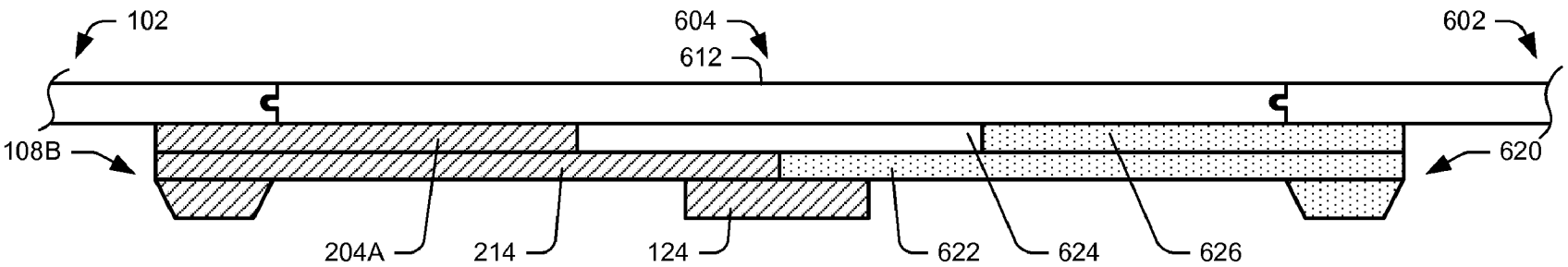

FIG. 6A and FIG. 6B depict an illustrative zipper 604 integrating two modular floor panels in a top view and an enlarged side view, respectively. More specifically, FIG. 6A and FIG. 6B illustrate modular floor panel 102 integrated to another modular floor panel 602 via the zipper 604. FIG. 6A illustrates zipper 604 being about forty-eight inches in width 606, which is the same as the modular floor panel 102 width 112. FIG. 6A further illustrates zipper 604 comprising a substantially planar floor surface 608 coupled to the substantially planar floor surfaces 104 and 610. As shown in FIG. 6A the zipper 604 is composed of three different parts, twenty-two inch tongue and groove planks 612, ten inch tongue and groove planks 614, and pre-assembled tongue and groove planks 616 (stippled in this figure for clarity). The zipper 604 when installed spans the distance between modular floor panels 102 and 602 in the longitudinal dimension 122. As illustrated in FIG. 6A, zipper 604 integrates modular panels 102 and 602 with staggered patterns 206 to avoid readily apparent seams.

FIG. 6B illustrates modular floor panel 102 integrated to another modular floor panel 602 via zipper 604. As FIG. 6B illustrates, modular floor panel 102 half-footing 108B (cross hatched for clarity) is coupled to modular floor panel 602 half-footing 620 (stippled for clarity). More specifically, FIG. 6B illustrates half-footing 108B having anchor 124 receiving half-deck 622 of half-footing 620. As FIG. 6B illustrates, the above described coupling of half-footings 108B and 620 provides structural support for zipper 604 disposed on top of both half-footings 108B and 620.

Figure 7A:
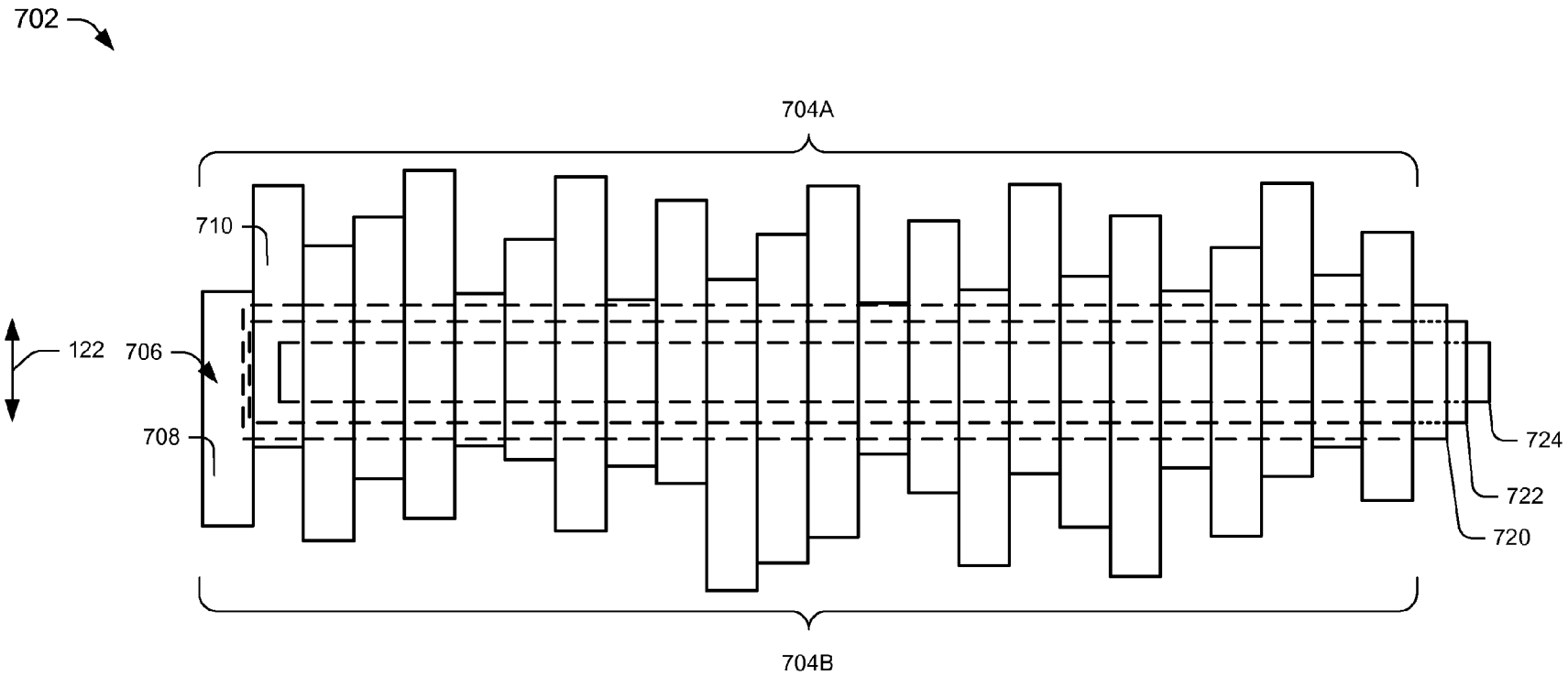
FIG. 7A and FIG. 7B illustrates a drop-in zipper used to integrate modular floor panels in a top view and an enlarged side view, respectively.
Figure 7B:
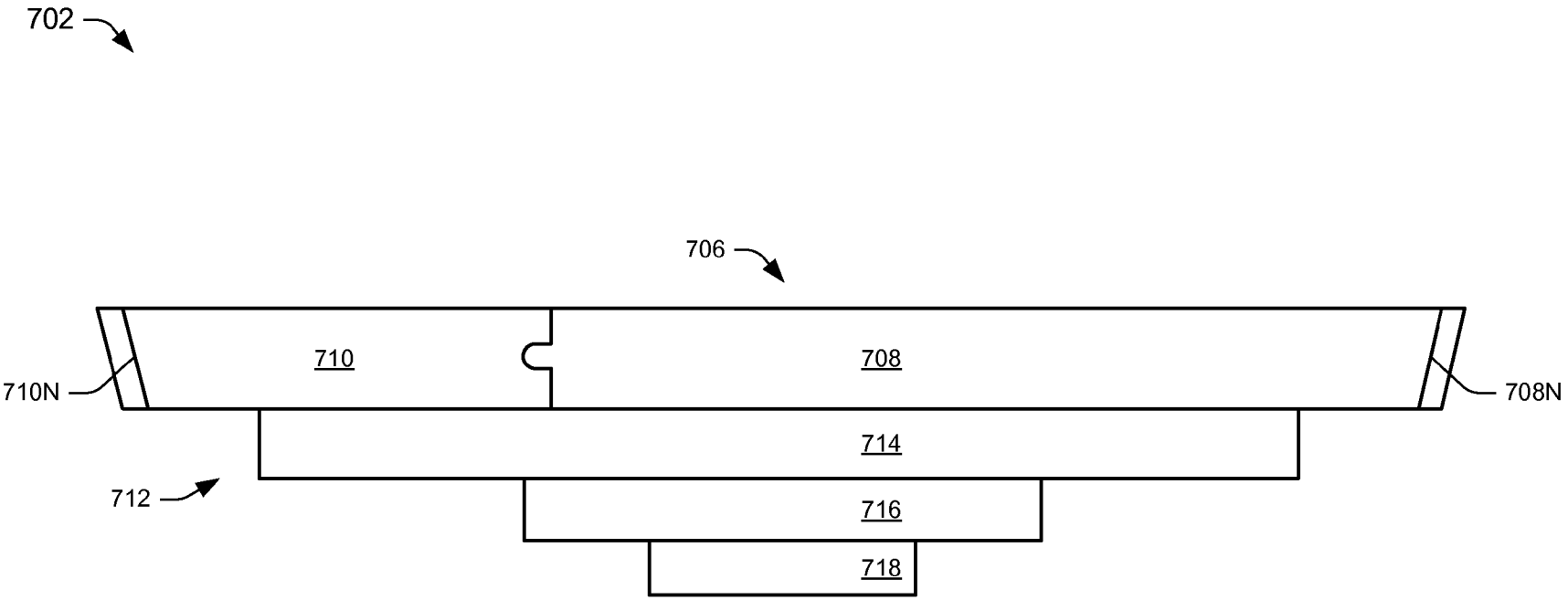

FIG. 7A and FIG. 7B illustrate top and side views, respectively, of a pre-assembled, drop-in embodiment of a zipper 702. Specifically, FIG. 7A illustrates planar fingers 704A and 704B extending distally from a substantially planar floor surface 706 in opposite directions to each other in the longitudinal direction 122. Planar fingers 704A and 704B are made of the same rugged and hard material as the substantially planar floor surface 104. Both sets of planar fingers 704A and 704B are illustrated in FIG. 7A as having similar staggered patterns for integrating and spanning the distance between modular floor panels (e.g., modular floor panels 102 and 602) in the longitudinal direction 708 so that the seams of integrated modular floor panels 102 in the longitudinal direction 708 are not readily apparent. In this embodiment, the zipper 702 consists of a single pre-assembled drop-in unit that is disposed between two adjacent modular floor panels, as opposed to a multi-piece kit like that shown in FIGS. 6A and 6B.

FIG. 7B illustrates a side view of zipper 702. As illustrated in FIG. 7B, finger 708 has an angled edge 708N and finger 710 has an angled edge 710N. Likewise, each finger of the zipper 702 comprises an angled edge. The angled edges provide for zipper 702 to "drop in place" in-between two modular floor panels in the longitudinal direction 122. Further, and as illustrated in FIG. 7B, zipper 702 may comprise a footing 712 coupled to and below the substantially planar floor surface 706. Footing 712, as illustrated in FIG. 7B, may comprise a support 714 coupled to and below substantially planar floor surface, a deck 716 coupled to and below support 714, and an anchor 718 coupled to and below deck 716.

Exemplary Method of Making and Installing a Modular Floor

Figure 8:
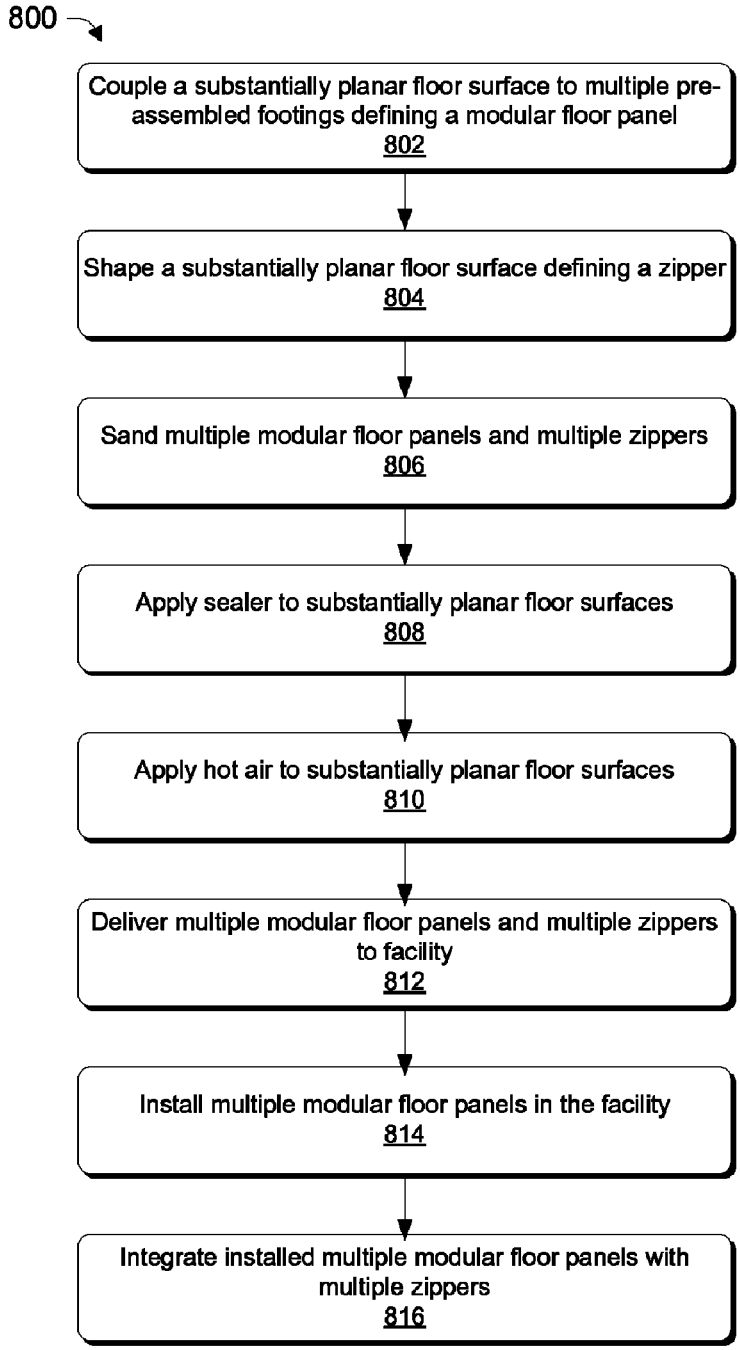
FIG. 8 is a flow diagram of an illustrative process for making and installing a modular floor.

FIG. 8 is a flow diagram of an example process 800 to make and install modular flooring. For convenience, the process 800 will be described with reference to the modular floor panel 102 and zipper 604, but the process 800 is not limited to use with these units. For example, a user may perform this process 800 to make a modular floor comprising modular panels 102 and zipper 702. In some instances, the user may perform part of this process in a manufacturing facility, and another part of the process at an installation site (e.g., gymnasium or sports event center).

Process 800 includes an operation 802, which represents fixing a portion of a substantially planar floor surface 104 to multiple pre-assembled footings 106A-106N, defining a modular floor panel 102. Here, as discussed above, substantially planar floor surface 104 comprises a rugged and hard material (e.g., tongue and groove maple boards). Next, process 800 proceeds to operation 804, which represents forming a zipper 604 (e.g., by cutting boards 612 and 614 to appropriate lengths and pre-assembling boards into assemblies 616). Operation 804 may be performed by a jig configured to cut a substantially planar floor surface 104 to the desired shape. Operation 804 is followed by operation 806, which represents sanding multiple modular floor panels and multiple zippers. Here, the sanding may be performed by using a table top multiple drum sander to achieve a desired finish without the chatter marks common in traditional wood floors that are sanded after installation. Following the sanding of multiple modular floor panels and multiple zippers, process 800 continues with operation 808, which represents applying a sealer to the substantially planar floor surfaces of the multiple modular floor panels and the multiple zippers. At operation 810, hot air may be applied to the sealer disposed on the planar surfaces of the multiple modular floor panels and the multiple zippers to speed the drying process and increase production speeds.

At operation 812, the multiple modular floor panels and the multiple zippers are delivered to a facility (e.g., an indoor basketball court). Process 800 continues at operation 814, where the multiple modular floor panels are installed adjacent to each other in the longitudinal and latitudinal directions. Once installed, there will be gaps in the substantially planar floor surface between adjacent modular floor panels in the longitudinal direction. Next, at operation 816, the multiple modular floor panels installed in the longitudinal direction are integrated by installing the zippers in the gaps to span the distance between longitudinally adjacent modular floor panels. At this point, the modular floor is completely installed and may be buffed, a second coat of sealer applied, painted to add any desired striping or graphics, maroon padded, and two coats of finish applied. After a three inch by four inch vented cove base is applied to the walls around a perimeter the modular floor will be ready to use.

Conclusion

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. For example, in various embodiments, any of the structural features and/or methodological acts described herein may be rearranged, modified, or omitted entirely.

What is claimed is:

1. A modular sports floor for installation in an event center, the modular sports floor comprising:

multiple modular floor panels, each modular floor panel comprising:

a substantially planar floor surface including tongue and groove planks pre-sanded and pre-sealed before the modular floor panel is installed in the sports event center, the multiple modular floor panels defining a substantially planar floor surface having a longitudinal dimension and a latitudinal dimension; and a set of staggered planar fingers extending distally from the substantially planar floor surface in a staggered pattern, the modular floor panels being disposed adjacent to each other in the longitudinal and latitudinal dimensions and defining a gap in the substantially planar floor surface between adjacent modular floor panels in the longitudinal dimension; and multiple zippers disposed in and spanning the gap in the substantially planar floor surface between adjacent modular floor panels in the longitudinal direction, wherein each zipper comprises a set of pre-fabricated zipper pieces comprising:

an individual tongue and groove plank shorter than another individual tongue and groove plank, the tongue and groove plank and the other tongue and groove plank each spanning the distance between modular floor panels in the longitudinal dimension and in the staggered pattern defined by the set of staggered planar fingers; and a unit of pre-assembled tongue and groove planks spanning the distance between modular floor panels in the longitudinal dimension and in the staggered pattern defined by the set of staggered planar fingers.

2. The modular floor of claim 1, wherein the modular floor panels are about 4 feet (1.2 meters) wide and about 20 feet (6.1 meters) long.

3. The modular floor of claim 1, wherein each modular floor panel comprises:

multiple footings coupled to and below the substantially planar floor surface;

a tongue extending distally from each of the footings in a direction perpendicular to the set of planar fingers;

another set of planar fingers extending distally from the substantially planar floor surface and opposite to the set of planar fingers; and a nook indenting into each of the footings on a side opposite to the tongue to receive a tongue of a footing of an adjacent modular floor panel.

4. The modular floor of claim 3, wherein each of the footings comprises:

a support coupled to and below the substantially planar floor surface;

a deck coupled to and below the support;

a damping mechanism coupled to and below the deck and along a perimeter of the deck; and an anchor coupled below the deck and along a middle longitudinal axis of the deck for anchoring the footing to a substrate; and multiple fasteners disposed along opposite edges of the deck and in an aperture defined between the substantially planar floor surface and the deck to couple the respective footing to a footing of an adjacent modular floor panel.

* * * * *